United States Patent [19]

Wilson

[11] Patent Number: 4,951,618

[45] Date of Patent: Aug. 28, 1990

[54] ROTARY ENGINE

[76] Inventor: Zade Wilson, 8629 Ormes Rd., Vassar, Mich. 48768

[21] Appl. No.: 372,887

[22] Filed: Jun. 28, 1989

[51] Int. Cl.[5] ..... F02B 75/22

[52] U.S. Cl. ..... 123/55 A; 123/56 BC

[58] Field of Search ..... 123/44 R, 44 A, 44 B, 123/44 C, 55 A, 56 AC, 56 BC, 52 A, 55 R

[56] References Cited

U.S. PATENT DOCUMENTS

| | | | |
|---|---|---|---|
| 835,337 | 11/1906 | Walker . | |
| 1,802,881 | 4/1931 | Dainton | 123/51 AA |
| 1,871,589 | 8/1932 | Dainton . | |
| 1,889,641 | 11/1932 | Dainton . | |
| 2,014,672 | 9/1935 | Schmaljohann | 123/55 A |
| 2,260,975 | 10/1941 | Hvid | 123/55 A |
| 2,264,648 | 12/1941 | Tebaldi | 123/55 A |
| 2,334,185 | 11/1943 | Fisk . | |
| 2,404,752 | 7/1946 | Schoenfeld et al. . | |
| 3,964,450 | 6/1976 | Lockshaw | 123/55 AA |
| 4,128,084 | 12/1978 | Sutherland | 123/55 AA |
| 4,291,651 | 9/1981 | Villella | 123/44 C |

*Primary Examiner*—David A. Okonsky

*Attorney, Agent, or Firm*—Gifford, Groh, Sprinkle, Patmore and Anderson

[57] ABSTRACT

A rotary engine construction of radially compact dimension. The engine comprises a cylinder block contained in a cylinder canister. The cylinders extend in a radial direction and have open outer ends though which the piston rods extend. A combination flywheel/ring gear including reinforcing ribs is positioned axially adjacent the cylinders and sheave gears. The ring, located interiorly of the sheave gears, significantly reduces the radial extent of the ring gear. The reinforcing ribs are provided close to the location of engagement of the ring gear with the sheave gears, allowing the ring gear to be radially thin. The resulting engine is both radially and axially compact and significantly lighter than prior rotary engine constructions.

10 Claims, 4 Drawing Sheets

ROTARY ENGINE

BACKGROUND OF THE INVENTION

I. Field of the Invention

The present invention is directed to an internal combustion engine, and more particularly to a rotary engine of radially compact dimension.

II. Description of a Prior Art

Various constructions for piston and the cylinder-type internal combustion engines have long been known. Each type is subject to its own drawbacks, however. Straight or "V" cylinder constructions are disadvantageous in that the amount of space required for the engine is considerable, they require complex internal cooling structures, and they are wasteful in requiring separate structures for drive transmission and the flywheel necessary for smooth operation of the engine between operation of the cycle of each piston. Cylinder and piston engines including a circular array of pistons and a rotating casing reduce some of these problems. Such constructions have included, among other parts, an interiorly facing gear surface on the rotary casing, engaged by and driven by a plurality of gears in turn driven by the pistons. Such constructions, however, result in an engine whose radial extent in all directions is wastefully large, since the driving gears must be surrounded by rotary casing. The large rotary casing is disadvantageous in its great weight, which increases in proportion to the square of its radius. Moreover, since the ring gear is disposed about the driving gears, the ring gears require that the ribs (if any) for reinforcing the ring gear must be actually spaced a significant distance from the drive gears, decreasing the effectiveness of the ribs and increasing the axial size of the ring gear to a disadvantageous extent.

SUMMARY OF THE PRESENT INVENTION

The present invention overcomes these and other problems by providing a rotary engine construction having a ring gear of significantly less radial extent than the rotary casings employed in prior constructions, yet which allows reinforcing ribs to extend across the ring gear in an axial location significantly closer to the plane of the cylinders than which might be employed in prior constructions, even if those constructions were modified to include such reinforcing ribs. More particularly, the rotary engine construction of the present invention comprises a cylindrical canister containing a cylinder block therein. A plurality of cylinder sheaves contain a matching plurality of pistons in them. The cylinders extend in a radial direction and have open outer ends through which piston rods extend. A plurality of flat sheave gears are fixed to the cylindrical canister in line with the open ends of the cylinders. Means that are provided for connecting the sheave gears to the piston rods for rotating the sheave gears about their individual axes. The cylinders, however, are in fixed position with respect to the canister. A combination flywheel/ring gear including reinforcing ribs is positioned axially adjacent the cylinders and the sheave gears. The ring gear includes a plurality of gear teeth on its outer periphery engaging the sheave gears. Recipication of the pistons in the cylinders thus rotates the sheave gears, which in turn drive the ring gear. The ring is thus located interiorly of the sheave gears, significantly reducing the radial extent of the ring gear, in comparison to prior rotating canisters. Moreover, since the sheave gears are not located interiorly of the ring gear, reinforcing ribs can be provided close to the location of engagement of the ring gear with the sheave gears, allowing the ring gear to be radially thinner then prior rotating canisters, while retaining the same strength and resistance to deformation during operation. The resulting engine is thus a more compact construction in both radial and axial extent, and is significantly lighter, then prior radial engine construction.

BRIEF DESCRIPTION OF THE DRAWING

A better understanding of the present invention will now be had upon reference to the following detailed description, when read in conjunction with the accompanying drawing, wherein like reference characters refer to like parts throughout the several views, and in which.

DETAILED DESCRIPTION OF THE PREFERRED EMBODIMENTS OF THE PRESENT INVENTION

FIGS. 1–7 show preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Figure 1:
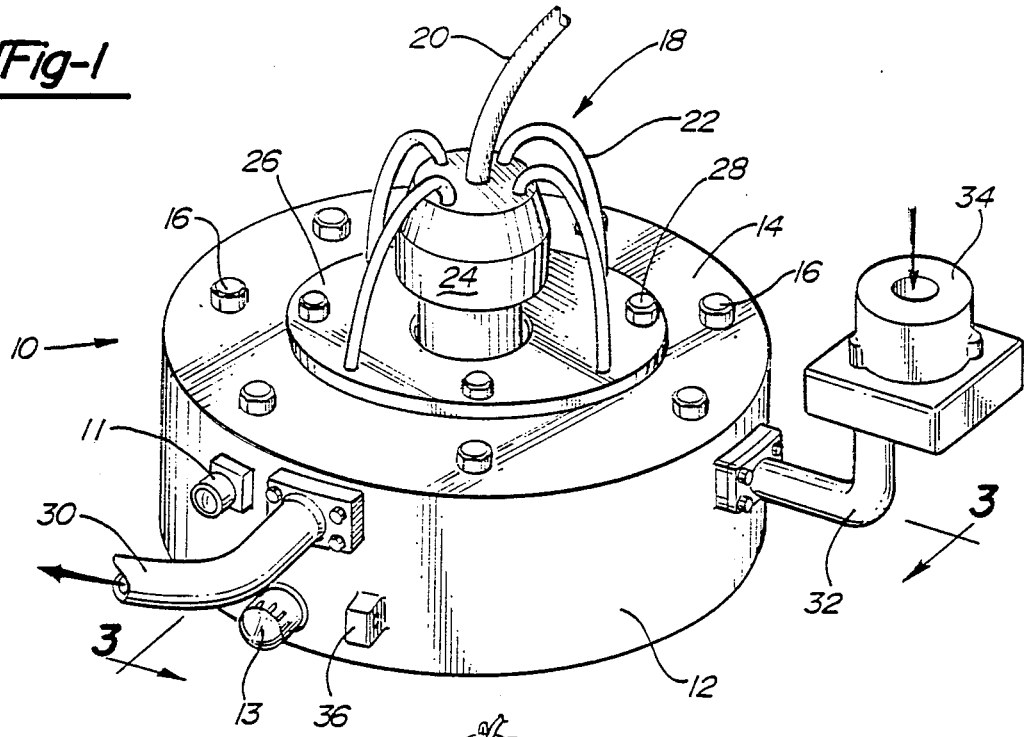
FIG. 1 is a perspective view of the preferred embodiment of the present invention.

With reference to FIG. 1, a perspective view of the rotary engine, generally indicated as 10, is portrayed. The engine 10 externally comprises a cylindrical canister 12 having a canister cover 14 fitted thereupon. The cover 14 is bolted to the canister 12 by means of a number of cover bolts 16.

At the top of the engine 10 is provided a distributor portion 18. The distributor portion 18 comprises a coil lead wire 20, a number of spark plug wires 22, a distributor assembly 24, and a removable distributor cover plate 26. The cover plate 26 is fittable to the cannister cover 14 by means of a number of cover plate bolts 28. A coolant outlet 11 is also provided. An oil filter 13 is shown.

While the engine 10 is preferably fitted with at least two exhaust lead pipes, only a single exhaust lead pipe 30 is visible according to the view of FIG. 1. An intake pipe 32 is provided to one side of the engine 10, with a carburetor 34 mounted thereon. While a number of engine mounting flanges are provided as required (preferably at least two), a single mounting flange 36 is visible according to the view of FIG. 1.

One of the foremost advantages of the present invention is its low profile which is clearly seen according to FIG. 1.

Figure 2:
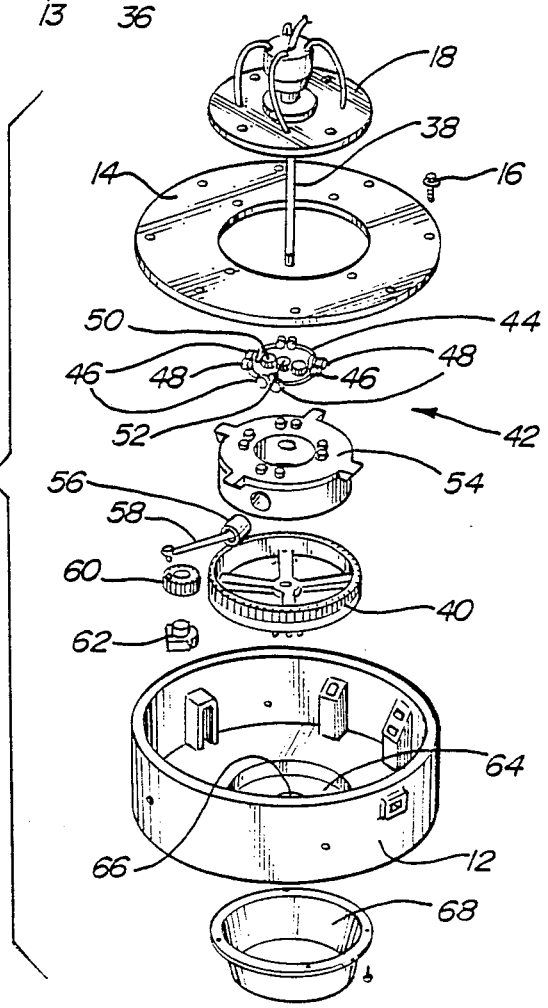
FIG. 2 is an exploded perspective view of the preferred embodiment of the present invention.

With reference to FIG. 2, an exploded perspective view of the engine 10 is illustrated. As can be seen by this view, the distributor portion 18 is removable as an assembly. A splined distributor shaft 38 is clearly shown for insertion into a flywheel/ring gear 40, described more fully below.

According to the exploded view of FIG. 2, below the distributor portion 18 is the canister cover 14. Thereunder is a valve actuating gear assembly 42. The gear assembly 42 comprises a valve actuating ring gear 44, four beveled intake valve gear-cam assemblies 46, four beveled exhaust valve gear-cam assemblies 48, a pair of valve actuating ring gear drive gears 50, and a shaft gear 52. The shaft gear 52 is mounted on the distributor shaft 38 and, upon rotation of the shaft 38, the shaft gear 52 drives each of the valve actuating ring gear drive gears 50 which in turn drive the valve actuating ring gear 44. The ring gear 44 has internally defined straight teeth for engagement with the pair of valve actuating ring gear drive gears 50. The ring gear 44 also has externally defined peripheral bevel gear teeth which engage the bevel gears of each of the intake valve gear-cam assemblies 46 and each of the exhaust gear-cam assemblies 48.

Illustrated below the valve actuating gear assembly 42, an engine block 54 is illustrated. The block 54 is shown as having four apertures for four pistons 56, although more or less such apertures and a like number of pistons may be provided.

With reference to the pistons 56, only one is shown for clarity. Likewise, only one piston connecting rod 58 is shown. The non-piston end of the connecting rod 58 connects to an off-center shaft provided on a substantially flat sheave gear 60. Each piston 56 is attached to a sheave gear 60. Each sheave gear 60 is rotatably mounted to a selected place within the canister 12. The sheave gears 60 are coplanar with one another. According to the illustrated embodiment, this attachment is accomplished by means of a sheave gear post assembly 62.

On reciprocation of the piston 56, the sheave gear 60 is caused to rotate. Each of the sheave gears 60 is engaged with the flywheel/ring gear 40 which has defined about its periphery a plurality of gear teeth.

Centrally press-fitted within the canister 12 is a race 64 which has defined in the center thereof a drive shaft aperture 66. Attached to the bottom side of the canister 12 is an oil pan 68.

Figure 3:
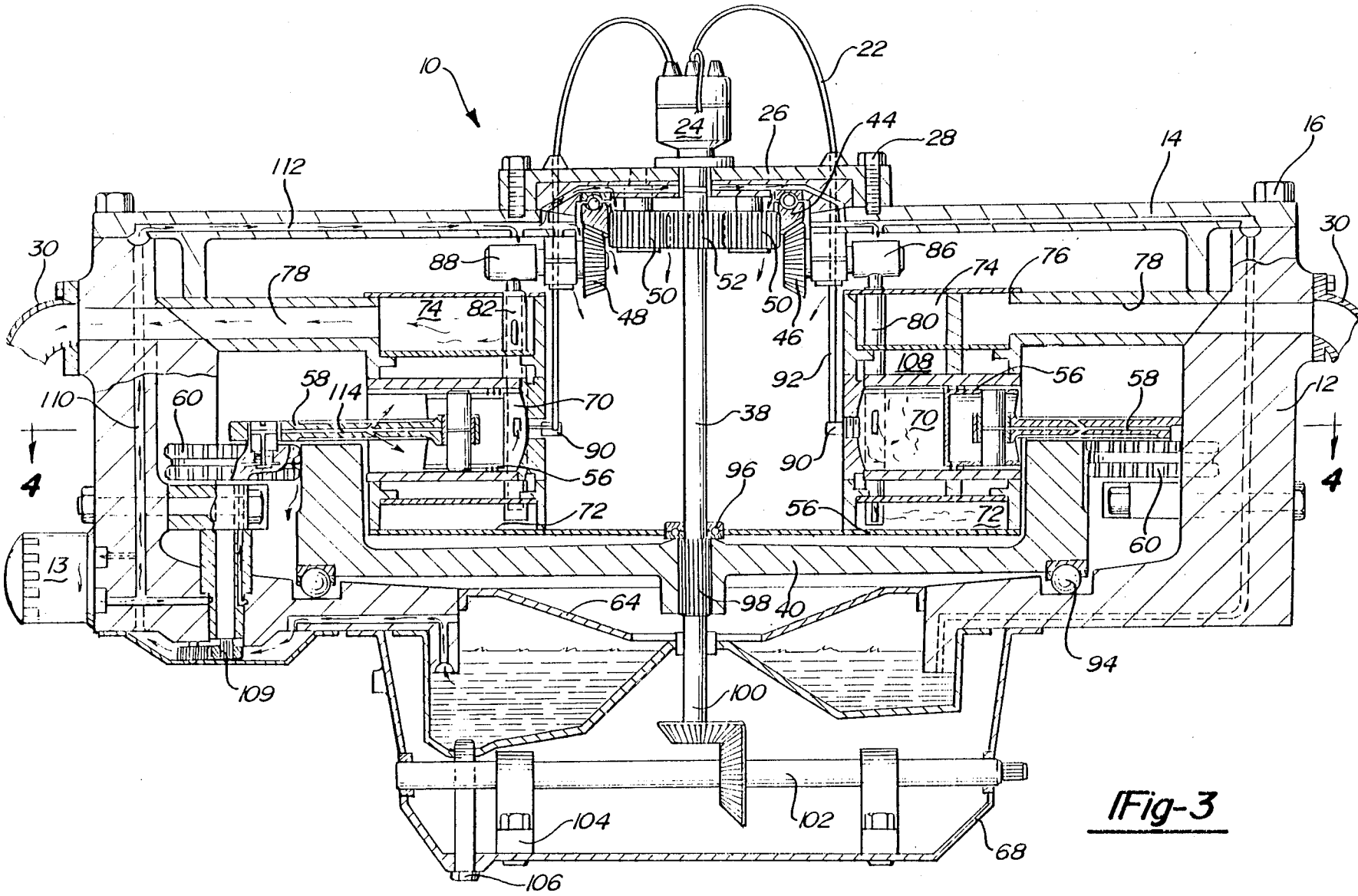
FIG. 3 is a cross-sectional view taken along lines 3—3 of FIG. 1.

With reference now to FIG. 3, a cross-sectional view taken along lines 3—3 of FIG. 1 is illustrated.

FIG. 3 helps to illustrate the paths followed by the intake and exhaust gasses and the lubricating and coolant fluids. The gasses basically circulate through ringed channels defined in the block 54 above and below the plane of a number of piston cylinders 70. The cylinders 70 are open to the sides of the block 54. Specifically, a ringed intake channel 72 is provided for circulation of intake gasses below each of the cylinders 70. A ringed channel 74 is provided for circulation of exhaust gasses above the cylinders 70. An exhaust channel cover 76 is fitted over the exhaust channel 75. As illustrated by the cross section of FIG. 3, a pair of exhaust manifolds 78 are fluidly interconnected with the exhaust channel 74.

To selectively communicate intake and exhaust gas into the cylinder 70, a number of spool-type reciprocally sliding valves are provided, a valve 80 representing the intake valve, and a valve 82 representing the exhaust valve. Each cylinder 70 is provided with one intake valve 80 and one exhaust valve 82. The valves 80, 82 have defined therein a channel for selectively communicating the bypassage of gas. According to FIG. 3, the illustrated intake valve 80 is in its "open" position to thereby communicate intake gas from the gas channel 72 into the cylinder 70. The gas is conventionally sucked into the cylinder by the downstroke of the piston 56. Concurrently, the exhaust valve 82 is also in its "open" position to thereby communicate exhaust gas from the cylinder 70 into the exhaust channel 74. The exhaust gas is conventionally forced out substantially at the compression stroke of the piston 56.

Each of the intake valves 80 is operated by the beveled intake gear-cam assembly 46, with a cam end 86 driving the valve 80, the valve 80 being spring loaded. Similarly, each of the exhaust valves 82 is operated by the beveled exhaust gear-cam assembly 48, with a cam end 88 driving the valve 82, the valve 82 being spring loaded. Both assemblies 46, 48 are driven by the rotating motion of the ring gear 44.

Each of the cylinders 70 is fitted with a specifically-designed spark plug 90. A stepped-up charge is selectively delivered from the coil (not shown) by the distributor assembly 24 to the respective spark plug 90 via a stiff spark plug cable 92. When the distributor assembly 24 is removed as a unit by loosening bolts 28 for servicing or inspection, the stiff cables 92 are likewise withdrawn from their respective spark plugs 90.

The construction and placement of the flywheel/ring gear 40 of the present invention may be more fully understood with reference still to FIG. 3. The gear 40 rides on a number of detachable roller bearings 94. A thrust bearing 96 is provided at the underside of the block 54 for providing rotational support for the flywheel/ring gear 40. The gear 40 has centrally defined splines 98 for removably receiving the end of the splined distributor shaft 38.

At the base of the flywheel/ring gear 40 is fitted a main drive shaft 100 which drives a secondary drive shaft 102 for providing usable output power. While a simple gear combination is shown, it must be understood that a transmission may be provided at the approximate base of the main drive shaft 100 for selectively providing driving force to the secondary drive shaft 102.

Fixing the secondary drive shaft to the base of the oil pan 68 is a drive shaft bearing 104. At the base of the pan 68 is provided an oil drain plug 106.

Cooling of the engine 10 is preferably accomplished by a liquid coolant that enters the engine 10 by an inlet pipe (not shown), circulates around and between the cylinders 70 by means of a number of coolant chambers 108, and, by means of a channeled route, leaves the engine 10 via the coolant outlet 11 (shown in FIG. 1) to be cooled in a radiator (not shown) for subsequent recirculation thereof.

Lubrication of the engine 10 is provided by an oil lubricant which is pumped by an oil pump 109 up through one path which leads to and through channels 110 defined within the canister 12 into channels 112 defined in the cover 14 for distribution to the gears 50, 52, the assemblies 46, 48, the shaft 38, the valves 80, 82, and the bearing 96.

The oil pumped by the oil pump 109 may instead take a second route up through the sheave gear post assemblies 62 and into and through a member of channels 114 defined with the piston rods 58. This latter course directs lubricant to the walls of the cylinders 70, the sheave gears 60, and to the bearings 94. The circulated oil is filtered by the oil filter 13.

Figure 4:
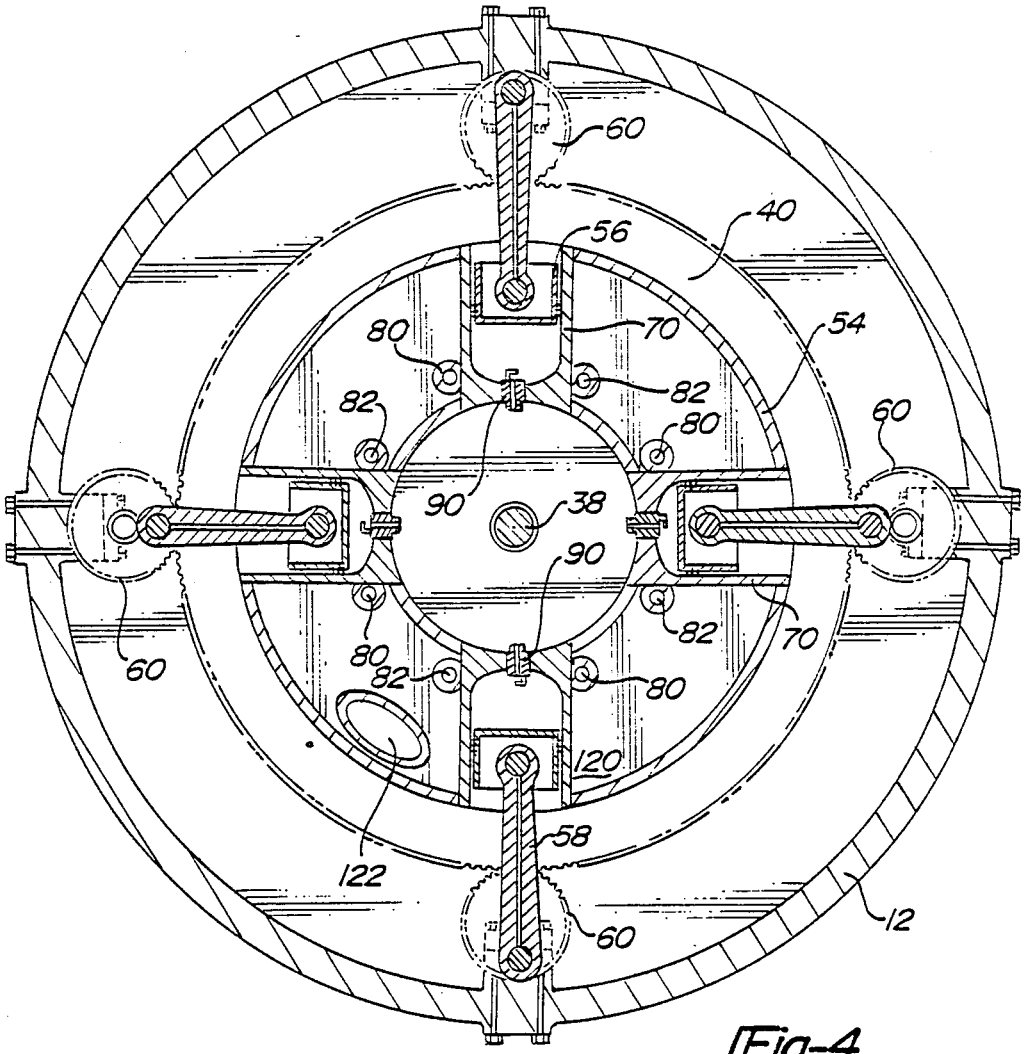
FIG. 4 is a cross-sectional view taken along line 4—4 of FIG. 3.

With reference now to FIG. 4, a cross-sectional view taken along line 4—4 of FIG. 3 is illustrated. This view offers a clear understanding of the placement and interrelation of the main components of the engine 10.

FIG. 4 particularly details well the placement of the ringed intake gas channel 72, of which a cover plate 120 may be seen. The cover plate 120 separates the gas channel 72 (below) from the coolant chamber 108 (above).

A gas intake port 122 is defined in the plate 120 through which a fuel mixture is communicated from the carburetor 34 (shown in FIG. 1) via an intake manifold (not shown) situated within the engine 10 between the carburetor 34 and the intake port 122.

Figure 5:
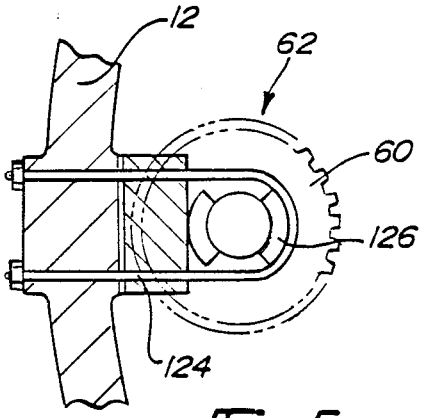
FIG. 5 is a partial cross-sectional view of the portion of the preferred embodiment of the present invention.

With reference to FIG. 5, the attachment of the sheave gear post assembly 62 to the canister 12 is illustrated. A hardened U-bolt 124 is applied for attachment. A pair of bearing blocks 126 provide a pair of bearing surfaces to facilitate rotation of the sheave gear 60.

Figure 6:
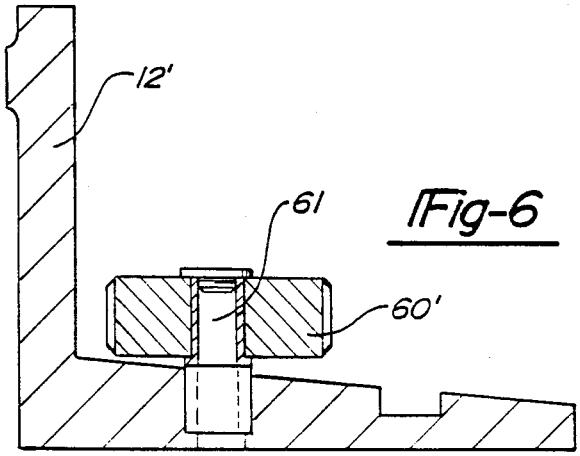
FIG. 6 is a cross-sectional view of the portion of another preferred embodiment of the present invention.

As an alternate means of fixing a sheave gear to a cannister, FIG. 6 illustrates a sheave gear 60' rotatably mounted to a canister 12' by a bearing stud 61. This embodiment may provide certain structural advantages as are understood.

Figure 7:
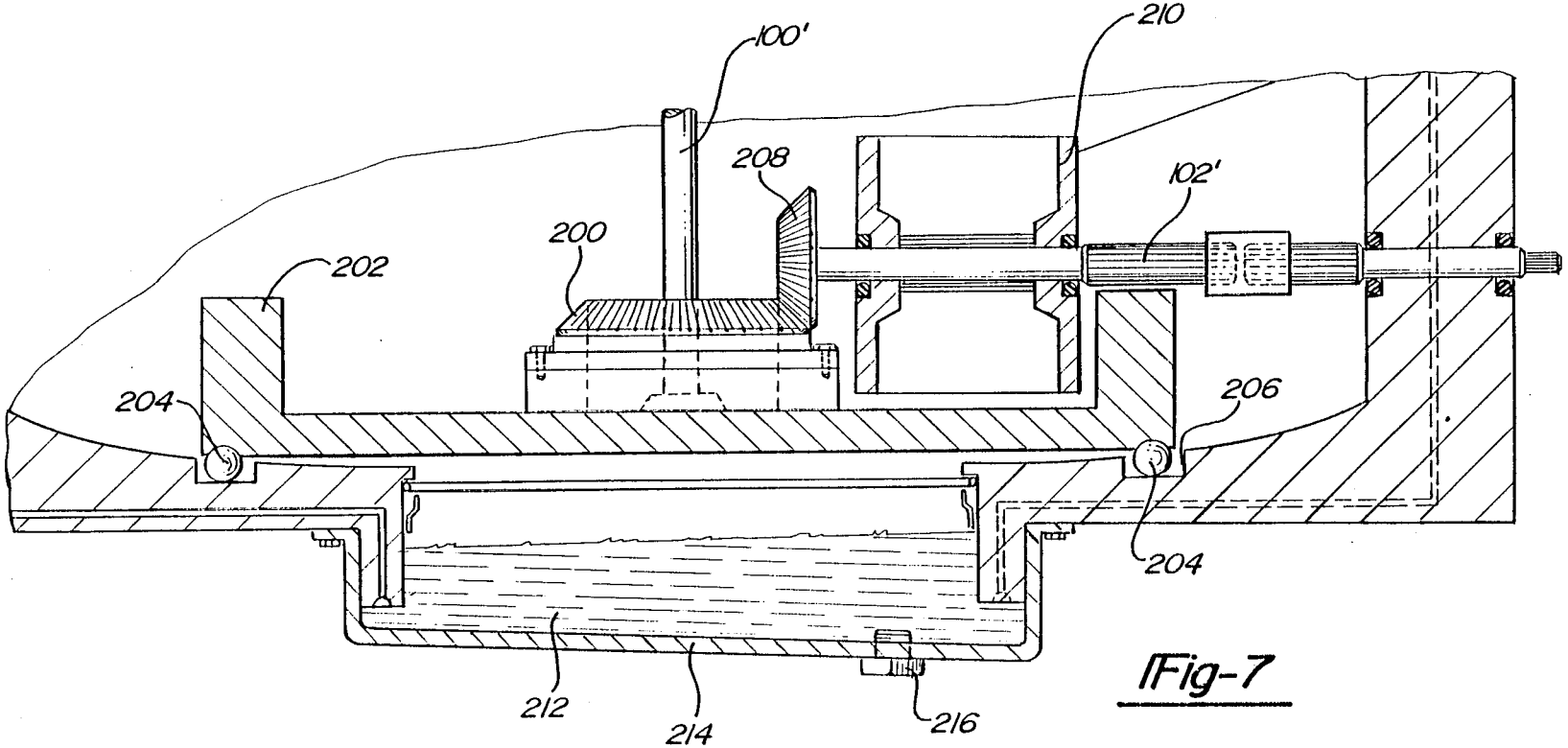
FIG. 7 is a cross-section of an alternate embodiment of the main drive shaft and secondary drive shaft arrangement.

With reference to FIG. 7, there is illustrated an alternate embodiment of the arrangement of the gears and drive shafts. A main drive shaft 100' is illustrated having at its lower end a main bevelled gear 200. Fixed to the base of the main bevelled gear 200 is a secondary flywheel 202 which, through a number of support bearings 204 provided in a channel 206, concurrently provides both support and momentum for the shaft 100'.

Power is transferred from the shaft 100' to a secondary drive shaft 102' by the rotary interaction of the main bevelled gear 200 with a secondary bevelled gear 208. Support for the secondary drive shaft 102' is provided by a shaft support member 210.

An oil sump 212 is defined by an oil pan 214. The pan 214 includes a drain plug 216 thereon.

Having described my invention, however, many modifications thereto may become apparent to those skilled in the art to which it pertains without deviation from the spirit of the invention as defined by the scope of the appended claims.

I claim:

1. An engine comprising in combination:

a cylinder block;

a plurality of cylinders contained in said cylinder block;

a matching plurality of pistons, each piston reciprocatingly received in one of said cylinders;

a matching plurality of piston rods, each rod connected to one of said pistons and extending outwardly from said block;

a plurality of sheave gears, each sheave gear having a sheave gear axis and a circumference disposed about said sheave gear axis bearing a set of gear teeth thereon;

means connecting a respective one of said sheave gears to a respective one of said pistons rods such that reciprocation of said pistons in said cylinders causes rotation of said sheave gears about said sheave gears axes;

a combination flywheel/ring gear having a ring gear axis and an outer circumference disposed about said axis bearing a set of ring gear teeth thereon; and means positioning said flywheel/ring gear such that said gear teeth on said flywheel/ring gear engaged said gear teeth on said sheave gears;

whereby said flywheel/ring gear is rotated about its axis by rotation of said sheave gears upon reciprocation of said pistons in said cylinders.

2. The invention according to claim 1, further comprising a cylindrical canister containing said cylinder block therein.

3. The invention according to claim 2, wherein each of said cylinders possesses an open end facing said canister, said piston rods passing through said cylinder open ends.

4. The invention according to claim 2, further comprising means mounting each of said sheave gears to said canister so as to be rotatable about said sheave gear axes.

5. The invention according to claim 4, wherein said mounting means positions each of said sheave gears in alignment with one of said open cylinder ends.

6. The invention according to claim 1, wherein said sheave gears are flat gears.

7. The invention according to claim 6, wherein said flat gears are substantially coplanar with one another.

8. The invention according to claim 1, wherein said cylinders are formed as the sleaves received in said block.

9. The invention according to claim 2, further comprising means for mounting said combination flywheel/ring gear in said canister for rotation about said flywheel/ring gear axes.

10. The invention according to claim 1 further including a secondary flywheel interconnected to said flywheel/ring gear by a drive shaft, said secondary flywheel being substantially coplanar with said flywheel/ring gear.

* * * * *